US008768198B2

(12) United States Patent
Yano

(10) Patent No.: US 8,768,198 B2
(45) Date of Patent: Jul. 1, 2014

(54) IMAGE FORMING APPARATUS WITH COOLING UNIT

(75) Inventor: Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 13/278,394

(22) Filed: Oct. 21, 2011

(65) Prior Publication Data

US 2012/0107009 A1 May 3, 2012

(30) Foreign Application Priority Data

Oct. 29, 2010 (JP) ..... 2010-244312
Oct. 12, 2011 (JP) ..... 2011-224974

(51) Int. Cl.
*G03G 21/20* (2006.01)

(52) U.S. Cl.
CPC ..... *G03G 21/206* (2013.01)
USPC ..... 399/92

(58) Field of Classification Search
CPC ..... G03G 21/206
USPC ..... 399/92
See application file for complete search history.

(56) References Cited

U.S. PATENT DOCUMENTS

| | | | | |
|---|---|---|---|---|
| 5,038,174 | A * | 8/1991 | Kato et al. | 399/92 |
| 6,070,026 | A * | 5/2000 | Claflin et al. | 399/92 |
| 6,141,512 | A * | 10/2000 | Nagano et al. | 399/92 |
| 7,747,186 | B2 * | 6/2010 | Miyamoto et al. | 399/92 |
| 2003/0147665 | A1 * | 8/2003 | Ahn et al. | 399/92 |
| 2004/0052545 | A1 * | 3/2004 | Satoh | 399/92 |
| 2006/0284960 | A1 * | 12/2006 | Kishi | 347/140 |
| 2007/0280721 | A1 * | 12/2007 | Kanai | 399/92 |

FOREIGN PATENT DOCUMENTS

| | | | | |
|---|---|---|---|---|
| JP | 11-38808 A | | 2/1999 | |
| JP | 11038808 A | * | 2/1999 | G03G 15/20 |
| JP | 2000-238320 A | | 9/2000 | |
| JP | 2000238320 A | * | 9/2000 | B41J 2/44 |
| JP | 2005-173335 A | | 6/2005 | |
| JP | 2006-12559 A | | 1/2006 | |
| JP | 2008-268527 A | | 11/2008 | |
| JP | 2008-268528 A | | 11/2008 | |
| JP | 2008268527 A | * | 11/2008 | |
| JP | 2009-237016 A | | 10/2009 | |
| JP | 2011-22296 A | | 2/2011 | |

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image forming apparatus includes a plurality of image forming units which are provided side by side at least in a horizontal direction, each of which includes a rotatable image bearing member and an image forming section adapted to form a toner image on the image bearing member, and an air blow device configured to generate an air flow to cool the plurality of image forming units. In addition, a belt is placed above the plurality of image forming units, and a changing member is disposed in a space below the belt and between two image forming units located next to each other among the plurality of image forming units and configured to change flowing direction of the air flow generated by the air blow device. The changing member directs the air flow to flow along a rotation axis direction of the image bearing member from both ends of an upper area of the space toward a center of the upper area of the space, and then flow from the center of the upper area of the space to below the space.

25 Claims, 9 Drawing Sheets

IMAGE FORMING APPARATUS WITH COOLING UNIT

BACKGROUND OF THE INVENTION

1. Field of the Invention

The present invention relates to an image forming apparatus such as a copier or printer provided with a function to form images on recording material such as sheets.

2. Description of the Related Art

An image forming apparatus, which performs image forming operations using precision techniques, contains components which will be affected if overheating occurs in the apparatus as a result of continuous operation. Above all, elements which particularly require consideration of impacts are imaging sections (image forming sections, process cartridges, toner cartridges and image forming units) involved in formation of toner images.

The imaging section includes elements, such as a developing blade and cleaning blade, which produce heat as a result of rubbing friction, where the developing blade regulates an amount of toner supply to a developing roller while the cleaning blade recovers untransferred toner remaining on a photosensitive drum after a transfer process. Since the toner has the property of being melted by heat, unless these elements are kept below a predetermined temperature, physical properties of the toner are changed by temperature rises, and consequently lumps of toner could get fused to a blade tip, drum surface, or the like. This phenomenon obstructs an imaging process and surfaces in the form of image defects.

A similar problem is generally encountered by those areas of the imaging sections which are concerned with storage and supply of toner, and unless a drive section, fixing device and electrical board of the image forming apparatus are prevented from overheating including thermal influence of the surroundings, it is difficult to guarantee image quality throughout the service life of the cartridges.

Monochrome products which have only one imaging section are relatively free from spatial constraints around the imaging section, flexible in forming cooling air flow paths, and thus able to avoid the above problem relatively easily.

In contrast, color products in which multiple imaging sections are arranged side by side are subject to very strong constraints on formation of air flow paths as follows if it is assumed that the imaging sections 70 are rectangular parallelepipeds as shown in FIG. 7. That is, of the six faces surrounding each imaging section, five faces are closed: two faces (71, 72) are closed by adjacent imaging sections, one face (73) is closed by an intermediate transfer belt, one face (74) is closed by a laser scanner, and one face (75) is closed by a drive section which drives the imaging section. Thus, there are very strong constraints on formation of air flow paths.

Recently, along with downsizing of image forming apparatus, spatial density of parts and units which make up the apparatus has been growing, resulting in still severe spatial constraints. Design concepts of interior overheat prevention are roughly classified into two types. One of the types consists in "providing sufficient interior cooling performance to ensure that safe temperature will not be exceeded under any conditions of continuous operation in guaranteed operating environment." The other type consists in "detecting interior temperature conditions by means of an interior temperature detection unit and switching to a safe operation mode intended to prevent further temperature rises, before safe temperature is exceeded." The former design concept will be adopted when sufficient cooling capacity is available for the image forming apparatus. Otherwise the latter design concept will be adopted.

Recent color products are subject to very strong constraints on formation of air flow paths as described above while printing speed which affects heat generation of a drive section and rubbing unit are increasing gradually, making it difficult to secure sufficient cooling capacity for the amount of heat generation. Consequently, the latter method is often selected. Even when the latter design concept is selected, it is very important as product performance to be able to prevent reductions in throughput (productivity) of image formation after switching to the safe operation mode, and thus there is demand to maximize equipment cooling performance.

Under the constraints related to an issue of interior temperature rises in color products, conventionally the imaging sections are cooled using techniques largely classified into two types as described below. One of the types involves forming a flow of air in one direction along a photosensitive drum 85 in an imaging section 80 as shown in FIG. 8. Examples include a technique disclosed in Japanese Patent Application Laid-Open No. 2008-268528. The technique involves supplying cooling air from one longitudinal end of the imaging section using a fan and venting air from another end using another fan. Examples of the other type include a technique disclosed in Japanese Patent Application Laid-Open No. 2005-173335. The technique involves directing cooling air at heat dissipating units installed at opposite ends of the imaging section and thereby releasing heat from the opposite ends.

However, conventional techniques have low cooling efficiency for the imaging sections, and thus have a problem in that it is difficult to satisfy cooling performance required of the products or that a large number of fans are required in order to complement the low cooling efficiency with an air flow volume. This will be described below concretely.

With the former of the conventional configurations (cooling in one direction along the drum), main causes of the low cooling efficiency are the following two factors (see FIG. 8).

- Reductions in air flow velocity and air flow volume on the downstream side of the air flow path
- Increases in temperature of the cooling air on the downstream side of the air flow path There are many open spaces in the imaging section, including a space for laser irradiation from a laser scanner 84 and a space for abutment and separation of a developing device, and a closed air flow path cannot be formed. Consequently, cooling air A supplied to one end of the imaging section 80 is diffused into the apparatus through the open spaces, and a clean flow cannot be formed in an entire area of the photosensitive drum 85. Also, when a drive unit 81 of the imaging section is located on the downstream side of the air flow path, it is difficult to secure an ideal exhaust route due to spatial constraints, and consequently the drive unit 81 generates such flow path resistance as to facilitate diffusion of the cooling air. Due to the influence of the above factors, the air flow velocity and air flow volume reduces downstream along the air flow path.

To ease this problem, a technique is known which reduces diffusion of air flow by installing a fan on the exhaust side as well as on the intake side, such as described in an embodiment disclosed in Japanese Patent Application Laid-Open No. 2005-173335. However, the fan on the exhaust side draws in heat from areas other than the imaging sections as well, making it difficult to achieve an intended cooling effect.

Also, the cooling air rises in temperature gradually in the course of removing heat from the imaging sections. With the configuration which uses a flow of air in one direction for cooling, the temperature of the cooling air increases downstream, reducing the cooling effect, and a large temperature distribution gradient occurs over an axial direction of the imaging sections. A maximum difference in the temperature distribution corresponds to a temperature difference (front-rear temperature difference) between frames 82 and 83 of the image forming apparatus. Generally, the imaging sections are positioned on the frames 82 and 83 of the image forming apparatus at both ends in an axial direction of the drums. The front-rear temperature difference between the frames results in a difference in amount of thermal expansion in positioning portions of the imaging sections, causing front-back difference to be produced in spacing between the positioning portions of adjacent imaging sections. The front-back difference causes a "problem of color misregistration" to output images. As shown in FIG. 8, an intermediate transfer belt unit 86, primary transfer roller 87 and intermediate transfer belt 88 are provided between the frames 82 and 83.

With the latter of the conventional configurations (heat dissipation from opposite ends of the imaging section), again it is difficult to increase the cooling efficiency for the following two reasons.

It is geometrically difficult to increase heat transfer effect of elements in the imaging section.

It is difficult to provide sufficient heat dissipating sections at the opposite ends of the imaging section.

Generally, elements of the imaging section have "elongated shapes" whose cross-sectional areas are very small compared to longitudinal dimensions. Consequently, the heat generated at the longitudinal center is not transmitted efficiently to both ends. Thus, it is difficult to achieve cooling effect by means of heat dissipation. This tendency becomes more pronounced with increases in the media width supported by the image forming apparatus, making it difficult to dissipate heat from both ends.

Also, although it is necessary to install heat dissipating members which have surface areas contributory to heat dissipation in the heat dissipating sections, it is not easy to install heat dissipating members of a sufficient size in the imaging section where a large number of elements are arranged densely. In particular, a large number of drive couplings and electrical contacts are laid out on the side of an interface between the imaging section and drive unit, creating very strong spatial constraints and making it difficult to supply cooling air to the interface at the same time.

As described above, since the conventional techniques are subject to strong constraints in increasing cooling efficiency, there is demand for a cooling technique which can solve this problem.

SUMMARY OF THE INVENTION

A purpose of the present invention is to reduce temperature differences in an image forming apparatus in which a plurality of image forming units are provided side by side along a belt and thereby improve cooling efficiency greatly over conventional cooling efficiency.

Another purpose of the present invention is to propose an image forming apparatus including a plurality of image forming units which are provided side by side, each of which includes a rotatable image bearing member and an image forming section adapted to form a toner image on the image bearing member; an air blow device adapted to generate air flow to cool the plurality of image forming units; and a changing member installed in a space between two image forming units located next to each other among the plurality of image forming units and adapted to change direction of the air flow generated by the air blow device, wherein the air flow generated by the air blow device flows from both ends toward a center of the space in a rotation axis direction of the image bearing member by the changing member.

A further purpose of the present invention is to provide an image forming apparatus including a plurality of image forming units which are provided side by side and each of which includes a rotatable image bearing member and an image forming section adapted to form a toner image on the image bearing member, a belt placed above the image forming unit and adapted to move in order to transfer a toner image formed on the image bearing member onto a recording material, and an air blow device adapted to generate air flow to cool the plurality of image forming units, wherein the air blow device is placed at a location corresponding to an approximate center of the belt in a rotation axis direction of the image bearing member, and the air flow generated by the air blow device passes through both sides of the belt in the rotation axis direction and moves from both ends toward a center in the rotation axis direction through a space between two image forming units located next to each other among the plurality of image forming units.

Still further features of the present invention will become apparent from the following description of exemplary embodiments with reference to the attached drawings.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will be described in detail below by way of example with reference to the drawings. However, the sizes, materials, shapes and relative locations of the components described in the following embodiments are to be changed as required depending on the configuration and conditions of the apparatus to which the present invention is applied, and the scope of the present invention is not limited to the embodiments described below.

(First Embodiment)

Figure 1:
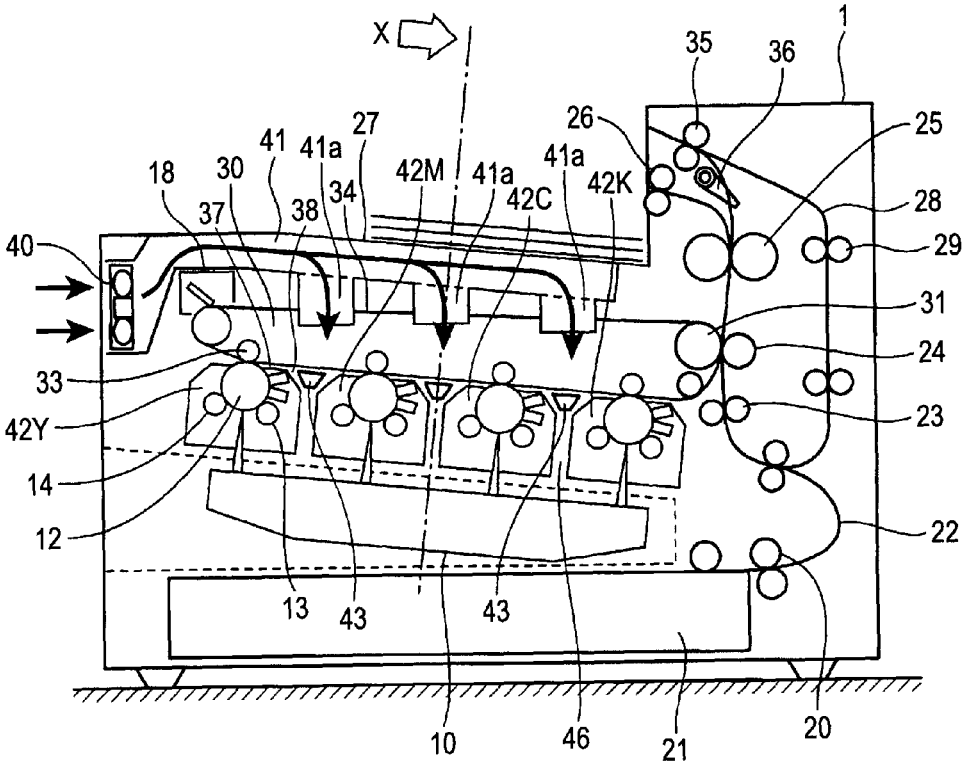
FIG. 1 is a sectional view showing a schematic configuration of an image forming apparatus according to a first embodiment.

A first embodiment of the present invention will be described with reference to FIGS. 1 to 3. FIG. 1 is a sectional view showing a schematic configuration of an image forming apparatus according to the present embodiment.

Imaging stations for forming primary images of yellow, magenta, cyan and black (hereinafter abbreviated to Y, M, C and K) for a total of four colors are laid out above a printer body (body of the image forming apparatus) 1.

Print data sent from an external apparatus such as a PC is received by a controller which controls the printer body 1 and output as write image data to a laser scanner 10. The laser scanner 10 irradiates photosensitive drums 12 with a laser beam and thereby draws laser images based on the write image data. The image forming apparatus according to the present embodiment is configured to irradiate Y, M, C and K photosensitive drums with laser using the single laser scanner 10.

Process cartridges 42 (denoted by 42Y, 42M, 42C and 42K, respectively, in FIG. 1) serving as imaging sections (image forming units) adapted to form primary images of Y, M, C and K colors are placed in respective imaging stations. The process cartridges are provided side by side along a travel direction of an intermediate transfer belt 34. All the process cartridges are substantially the same in configuration and operation except for differences in toner color. Therefore, only components of the process cartridge 42Y are denoted by reference numerals in FIG. 1, and configuration and operation of the process cartridge will be described below.

The process cartridge 42 includes the photosensitive drum 12 serving as a rotatable image bearing member, a charging unit 13, a developing unit 14, and a cleaner (not shown). The charging unit 13 is intended to uniformly charge a surface of the photosensitive drum 12. The developing unit 14 is intended to develop an electrostatic latent image into a toner image to be transferred to the intermediate transfer belt 34, where the electrostatic latent image is formed when the laser scanner 10 draws a laser image on the surface of the photosensitive drum 12 charged by the charging unit 13. The cleaner is intended to remove any toner remaining on the photosensitive drum 12 after the toner image is transferred. The charging unit 13, laser scanner 10, developing unit 14 and cleaner make up an image formation unit (a process unit acting on the photosensitive drum 12) intended to form a toner image on the photosensitive drum 12. The process cartridge 42 can be constructed by integrating at least one component of the process unit and the photosensitive drum into a cartridge and configured to be detachable from the printer body 1.

A primary transfer roller 33 is placed at a location facing the photosensitive drum 12, to serve as a transfer member adapted to transfer the toner image developed on the surface of the photosensitive drum 12 to the intermediate transfer belt 34.

The toner image (primary image) transferred (primary transfer) to the intermediate transfer belt 34 reaches a secondary transfer section by a movement of the intermediate transfer belt, and then is transferred onto a recoding material such as a sheet at the secondary transfer section. That is, the toner image transferred onto the intermediate transfer belt is transferred again onto the recording material in the secondary transfer section made up of a secondary transfer roller 31 and a secondary transfer outside roller 24, where the secondary transfer roller 31 combines the intermediate transfer belt 34 and the secondary transfer outside roller 24 is placed facing the secondary transfer roller 31. Any toner remaining on the intermediate transfer belt 34 without being transferred onto the recording material in the secondary transfer section is recovered by an intermediate transfer belt cleaner 18.

A feeding unit 20 is located most upstream in a recording material conveyance direction and installed below the printer body 1. The recording material mounted and contained in a feed tray 21 is fed by the feeding unit 20 and conveyed downstream through a conveyance path 22. A registration roller pair 23 is placed on the conveyance path 22 to apply a final skew correction to the recording material and adjust timing between an image write by the imaging section and recording material conveyance.

A fixing roller 25 used to fix the toner images on the recording material as a permanent image is installed downstream of the imaging section. A discharge conveyance path leading to a discharge roller 26 and a reverse path equipped with a reversal roller 35 are installed downstream of the fixing roller 25, where the discharge roller 26 is used to discharge the recording material from the printer body 1 and the reversal roller 35 is used to reverse the conveyance direction of the recording material for duplex printing. The path to lead the recording material to can be selected by switching a reverse deflector 36.

After simplex printing or after printing on the second side of duplex printing, the recording material is led to the discharge conveyance path and is then discharged among the apparatus by the discharge roller 26. The discharged recording material is loaded onto an output tray 27 installed on top of the printer body 1.

On the other hand, after printing on the first side of duplex printing, the recording material is led to the reverse path, has its conveyance direction reversed by the reversal roller 35, and is conveyed to a duplex conveyance path 28 to return to the imaging section. A duplex conveyance roller 29 is installed on the duplex conveyance path 28 to refeed the recording material conveyed in the reverse direction by the reversal roller 35 to the imaging section.

A cooling configuration around the process cartridges according to the present embodiment will be described below. A single fan 40 is installed on the left flank (flank on the left side in FIG. 1) of the printer body 1 to take fresh air into the apparatus. The location of the fan 40 in the longitudinal direction of the process cartridges 42 corresponds to an approximate center of the intermediate transfer belt 34 in the longitudinal direction. Downstream of the fan 40, a duct 41 serving as a branching member is installed between the output tray 27 and intermediate transfer belt 34. Straightening vanes (not shown) are installed in the duct 41 to divide the cooling air into two directions, i.e., direction toward front part and direction toward rear part of the apparatus, and regulate the cooling air so as to provide appropriate air flow volumes around the process cartridges. By placing the fan 40 as described above and dividing the cooling air into two directions, i.e., the direction toward the front part and direction toward the rear part of the apparatus, an air flow volume of cooling air flowing toward the front part of the apparatus and an air flow volume of cooling air flowing toward the rear part of the apparatus can be made substantially equal, thereby preventing uneven cooling between the front and rear parts in the apparatus.

In relation to the printer body 1, the term "front" means the front side of FIG. 1 (one side in the rotation axis direction of the photosensitive drums 12, i.e., the longitudinal direction of the photosensitive drums 12 and process cartridges 42). On the other hand, the term "rear (back)" means the rear side of FIG. 1 (the other side in the rotation axis direction of the photosensitive drums 12). When the printer body 1 is viewed from the right side of FIG. 1, the left side corresponds to the "front" and the right side corresponds to the rear." In spaces between the intermediate transfer belt 34 and multiple photosensitive drums 12, the fan 40 and duct 41 generate air (cooling air, air flow) moving toward both longitudinal ends of the photosensitive drums 12. The fan 40 and duct 41 make up an air blow unit adapted to generate air flow for cooling the process cartridges 42.

Figure 2:
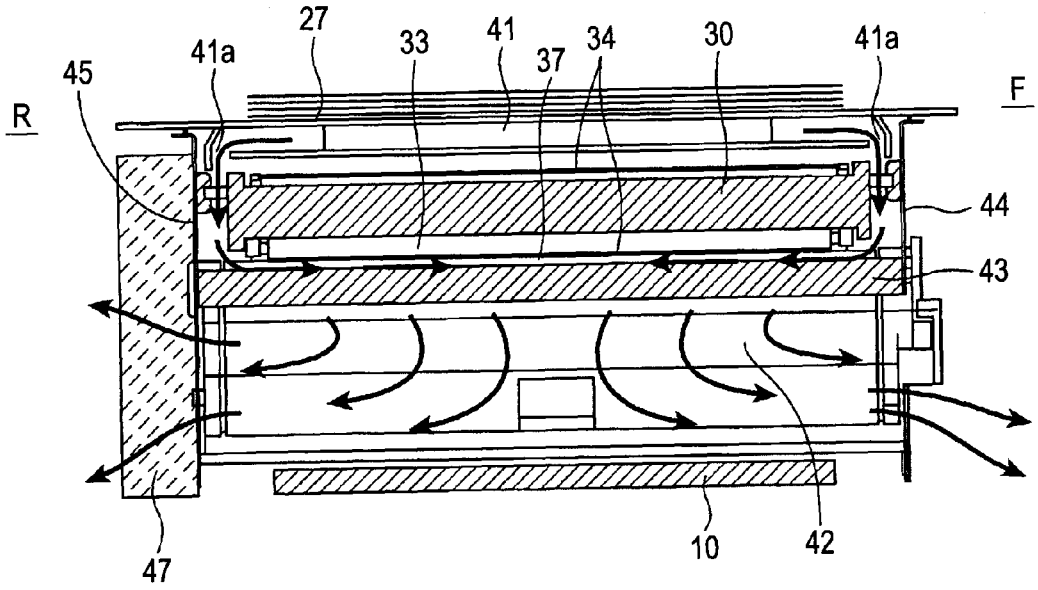
FIG. 2 is a schematic diagram of a cross section X taken along a dashed line in FIG. 1.

FIG. 2 shows a schematic diagram of a cross section X taken along a dashed line in FIG. 1. Arrows in FIG. 2 represent flow of cooling air.

The cooling air divided in the duct 41 is led to spaces (gaps, air flow paths) such as described below through duct openings 41*a* and supplied toward a longitudinal center (center in the rotation axis direction) from both longitudinal ends of the process cartridges 42 (both ends in the rotation axis direction). Specifically, the spaces include gaps (spaces, air flow paths) 37 whose wall faces are formed by front and rear side plates 44 and 45, an intermediate transfer belt unit 30, and the process cartridges 42; and spaces (including the gap 37 and an after-mentioned gap 38) between each two process cartridges 42 located next to each other. The front side plate 44 and rear side plate 45 are side plates provided at both ends of the process cartridges 42 in the longitudinal direction out of side plates which make up a frame (frame members) of the printer body 1. Also, as shown in FIG. 1, the duct openings 41*a* are provided facing respective spaces between respective pairs of process cartridges 42 located next to each other. This enables delivering cooling air to the gaps 37 efficiently. Also, the duct 41 provides an air flow path in order for the cooling air to be supplied to the gaps 37 by passing outside both ends of the intermediate transfer belt unit 30 in the longitudinal direction of the process cartridges 42. When the air flow path is configured in this way, since that part of the intermediate transfer belt 34 which makes up the gaps 37 is less prone to direct exposure to cooling air, the toner images on the intermediate transfer belt 34 do not get disturbed easily.

When passing through the spaces, the cooling air also cools the front side plate 44 and rear side plate 45 and thereby reduces temperature difference between the front and rear side plates 44 and 45. This reduces color misregistration of color images caused by difference in thermal expansion between the front and rear side plates 44 and 45.

Also, the front and rear side plates 44 and 45 have positioning portions which are used to position the process cartridges 42 and are configured to be supplied with the cooling air blown by the fan 40. This reduces thermal expansion difference produced in the positioning portions, thereby reduces front-back difference produced in spacing between the positioning portions of adjacent process cartridges, and thereby reduces color misregistration of color images. The volume and location of cooling air supply to the process cartridge at each imaging station are optimized according to heat distribution characteristics in the printer body 1 and the like.

Stay members 43 adapted to couple the front side plate 44 and rear side plate 45 are installed between adjacent process cartridges (located next to each other), facing the intermediate transfer belt 34. The stay members are installed, forming gaps in conjunction with the respective process cartridges 42. The stay members 43 function as guide sections when the process cartridges 42 are attached and detached to/from the apparatus body. Also, exhaust spaces 46 are formed between adjacent process cartridges 42 to finally discharge the cooling air sent by the fan 40 to outside the apparatus through the gaps 37.

Out of spaces between two process cartridges 42 located next to each other, the gaps 38 provided between the stay members 43 and process cartridges 42 serve as air flow paths running from the side of the intermediate transfer belt 34 (from the side of the gaps 37) to the side of the exhaust spaces 46. As the stay members 43 are provided, air (cooling air) flows to the entire areas of the gaps 37 and gaps 38 in the longitudinal direction, cooling the longitudinal centers of the process cartridges 42.

In this way, the stay members 43 regulate volumes of air flowing to the exhaust spaces 46 through the gaps 37 and gaps 38, over the entire areas of the exhaust spaces 46 in the longitudinal direction. Also, the stay members 43 regulate flow rates of the air flow generated by the fan 40 such that the air flow generated by the fan 40 will reach the longitudinal centers of the gaps 37 and gaps 38. Thus, the stay members 43 correspond to flow rate regulating members. Being installed between two adjacent image forming units located next to each other, each stay member has facing portions (facing surfaces) which face the respective image forming units across respective gaps and regulates the flow rates of the air flow taking place between the facing portions and image forming units.

Thanks to stay members 43, the gaps 37 and gaps 38 are shaped so as to equalize a temperature distribution in the elements (components) of the process cartridges 42 wherever possible in the longitudinal direction (the rotation axis direction of the photosensitive drums 12) during image forming operation. According to the present embodiment, a supplied air volume of cooling air is equalized sufficiently closely over the entire areas so that the cooling air will flow uniformly over the entire areas of the gaps 37 and gaps 38 in the longitudinal direction. In this way, by regulating the flow rate of the air flow, the stay members 43 serving as flow rate regulating members change the flow direction of the cooling air flowing down toward the cartridges on both sides of the belt unit 30 to the rotation axis direction of the photosensitive drums 12. As the flow direction of the cooling air is changed in this way, the cooling air is set to flow uniformly over the entire areas of the gaps 37 and gaps 38 in the longitudinal direction. In other words, the stay members 43 also function as changing members adapted to change the flow direction of the cooling air.

Figure 9:
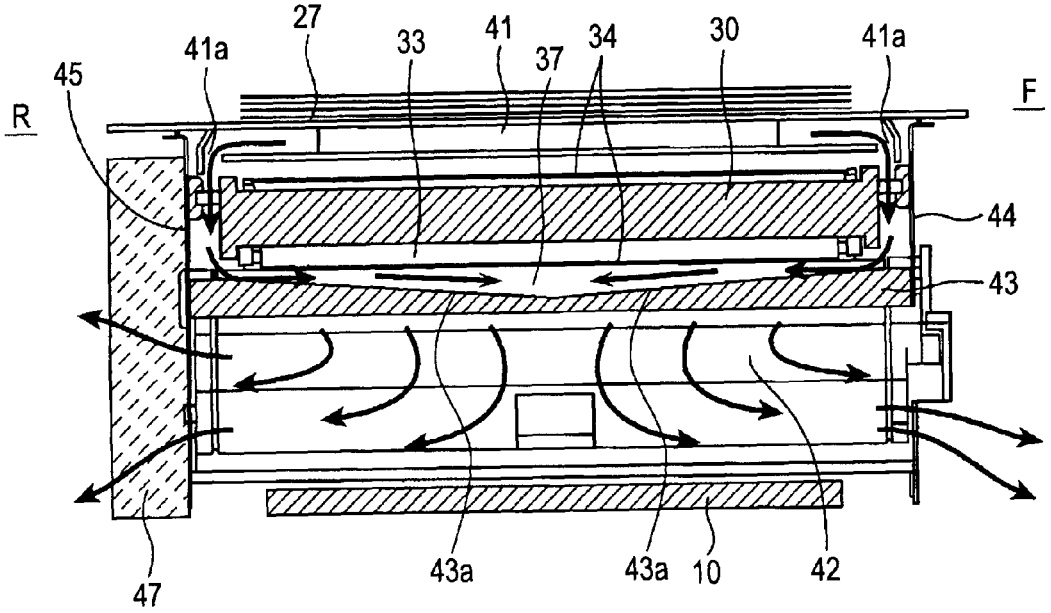
FIG. 9 is a schematic diagram of a cross section X taken along the dashed line in FIG. 1.
Figure 10:
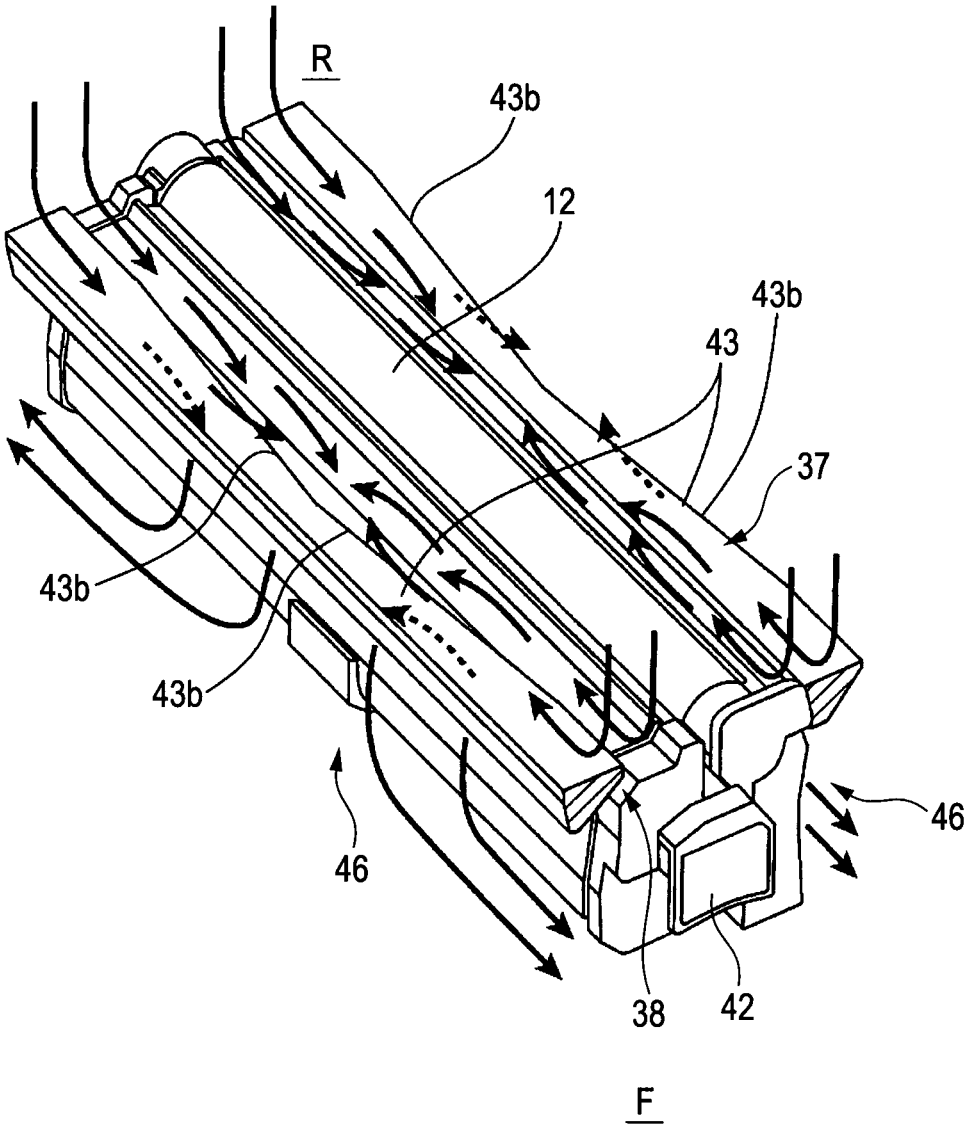
FIG. 10 is a perspective view showing how cooling air flows around a process cartridge.

Also, the gap may be shaped to facilitate inflow of the cooling air into the longitudinal center by making the gap larger at the longitudinal center than at both longitudinal ends as shown in FIGS. 9 and 10. FIG. 9 is a sectional view of a cross section X in FIG. 1. As shown in FIG. 9, tapered portions configured such that the distance from the intermediate transfer belt 34 will increase toward the center from both longitudinal ends are provided on intermediate transfer belt facing portions (facing surfaces) 43*a* of the stay member 43 facing the intermediate transfer belt. Consequently, the gap 37 becomes wider from both ends in the longitudinal direction (rotation-axis direction) toward the center in the longitudinal direction. FIG. 10 is a perspective view showing how cooling air flows around the process cartridge. As shown in FIG. 10, tapered portions such that the distance from the process cartridge 42 will increase toward the center from both longitudinal ends are provided on cartridge facing portions (facing surfaces) 43*b* of the stay member 43 facing the cartridge. Consequently, the gap 38 becomes wider from both ends in the longitudinal direction (rotation-axis direction) toward the center in the longitudinal direction. A taper-shape to be provided at the cartridge facing portions 43*b* of the stay member 43 may be provided at least at one of the cartridge facing portions 43*b* that faces one of two process cartridges 42. This also allows air (cooling air) to flow to the entire areas of the gaps 37 and gaps 38 in the longitudinal direction, cooling the longitudinal centers of the process cartridges 42. Incidentally, the tapers on the stay member 43 described above may be provided on the intermediate transfer belt facing portions 43*a* and cartridge facing portions 43*b*. Alternatively, the process cartridge 42 may be tapered to increase the distance between the process cartridge 42 and cartridge facing portions 43*b*.

After flowing out to the exhaust spaces 46, the cooling air is discharged to outside the apparatus by passing through gaps among units and parts in the printer body 1. On the front side (denoted by F in FIG. 10) of the printer body 1, the cooling air is discharged through gaps in a cartridge replacement door and exterior. On the rear side (denoted by R in FIG. 10) of the printer body 1, passing through an apparatus drive section 47 and electrical section, the cooling air is discharged through an exhaust louver installed in a back cover by involving exhaust heat of these heat sources. From the standpoint of preventing scattered toner from adhering to an optical system of the laser scanner 10, inflow of air into space surrounding the laser scanner 10 from the exhaust spaces 46 is regulated. Movement of air in this direction can be prevented, for example, if air pressure in laser scanner space is kept high using another fan (not shown).

Figure 3:
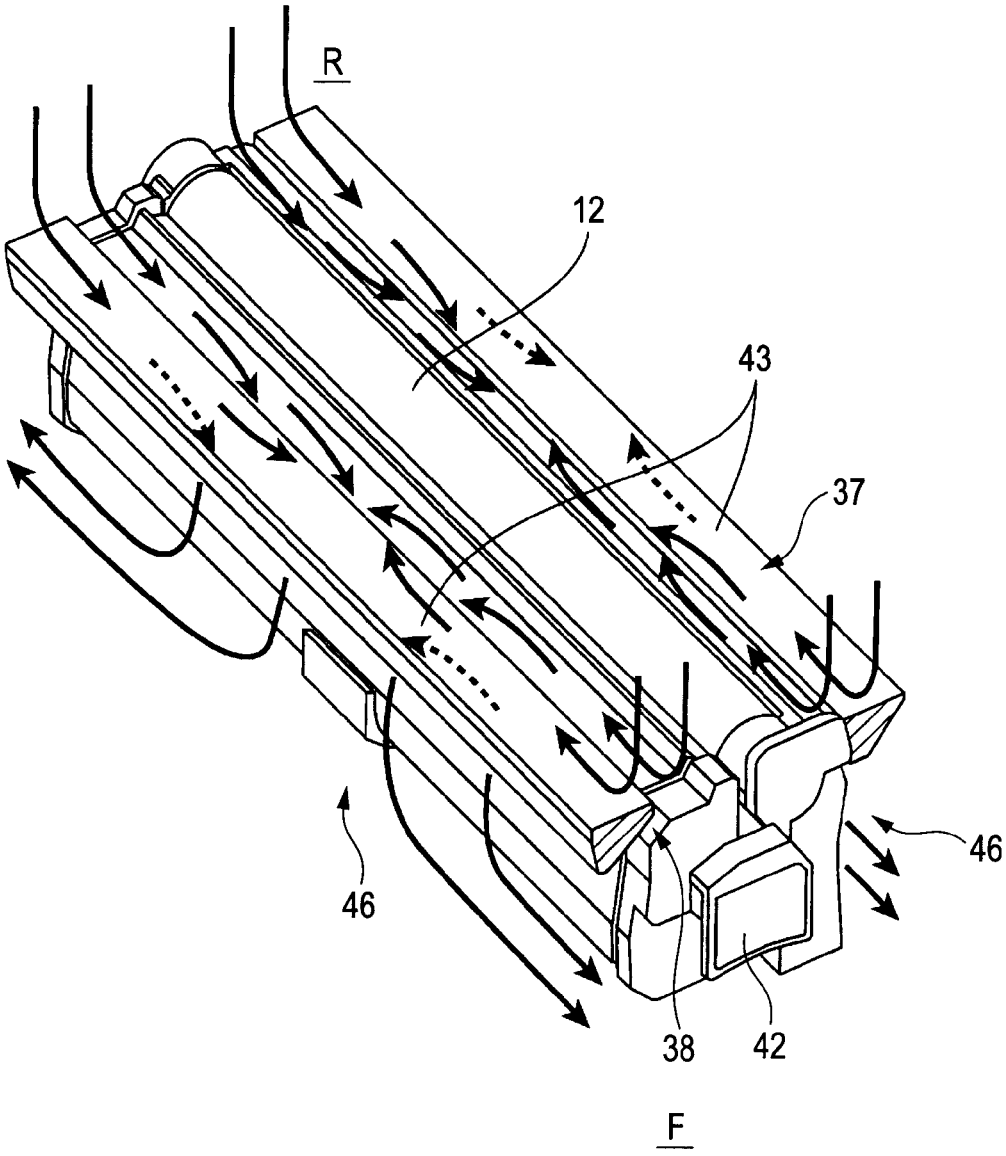
FIG. 3 is a diagram showing how cooling air flows around a process cartridge according to the first embodiment.

FIG. 3 shows how cooling air flows around the process cartridge 42 (cooling air paths) in the cooling configuration for the imaging section according to the present embodiment. First, the cooling air flows into near the longitudinal center of the process cartridge 42 along the periphery of the photosensitive drum 12 where self-heating elements are concentrated. In so doing, the cooling air removes heat directly from the elements around the photosensitive drum 12, achieving higher cooling efficiency. Also, the flow of the cooling air reduces the front-rear temperature difference in the longitudinal direction and makes the temperature distribution in the longitudinal direction uniform due to heat dissipation effect near opposite ends of the element.

The flow of air from the side of the intermediate transfer belt 34 toward the exhaust spaces 46 through the gaps between the process cartridges 42 and stay members 43 takes place, enveloping the entire process cartridges 42. Also the flow from the exhaust spaces 46 to outside the apparatus moves from the longitudinal centers of the entire process cartridges 42 in two directions, i.e., the direction toward front part and direction toward rear part of the apparatus, resulting in "flows of air from inside the printer body 1 to outside the printer body 1." The flows of cooling air produce the effect of cooling the entire process cartridges uniformly as well as blocks inflow of heat from adjacent external units such as the fixing device, apparatus drive section and electrical section toward the process cartridges 42.

As described above, in an image forming apparatus having a plurality of imaging sections, if the present invention is applied to the cooling configuration for the imaging sections, the cooling efficiency can be improved greatly over conventional cooling efficiency and drawbacks of conventional techniques can be solved as well.

As cooling air is supplied from opposite ends of the imaging sections to the spaces between the imaging sections and transfer section and air is discharged to exhaust air paths provided between adjacent imaging sections with the air flow volume being regulated, cooling air paths having the following features can be formed.

- Cooling air can be supplied to near the longitudinal centers of the imaging sections, resulting in well-balanced cooling (without heat stagnation in the center).
- The elements (developing blades, cleaning blades, and the like) around the photosensitive drums which are main heat-producing parts in the imaging sections can be cooled directly.
- The flow of air which envelops the entire imaging sections cools the imaging sections uniformly and eliminates heat stagnation between adjacent imaging sections.
- Regarding exhaust routes, due to pressure differences between inner part and outer part of the image forming apparatus, flow "from inside to outside" is formed, moving from the centers of the imaging sections to outside the image forming apparatus. This blocks heat coming into the imaging sections from external heat sources.

Being provided with these features, the cooling air paths according to the present invention offer the following advantages.

- A marked cooling effect can be obtained with a small air flow volume.
- Longitudinal front-rear temperature differences of side plates around the imaging sections can be eliminated, where such temperature differences could otherwise cause color misregistration.
- Compared to conventional techniques which use a plurality of fans, the number of funs can be reduced to one, contributing to size reductions, power savings, and sound reductions of the product.

When image forming apparatus are demanded to combine operating performance with environmental performance such as size reductions, power savings, and sound reductions, the present invention provides great effects.

[Second Embodiment]

Figure 5:
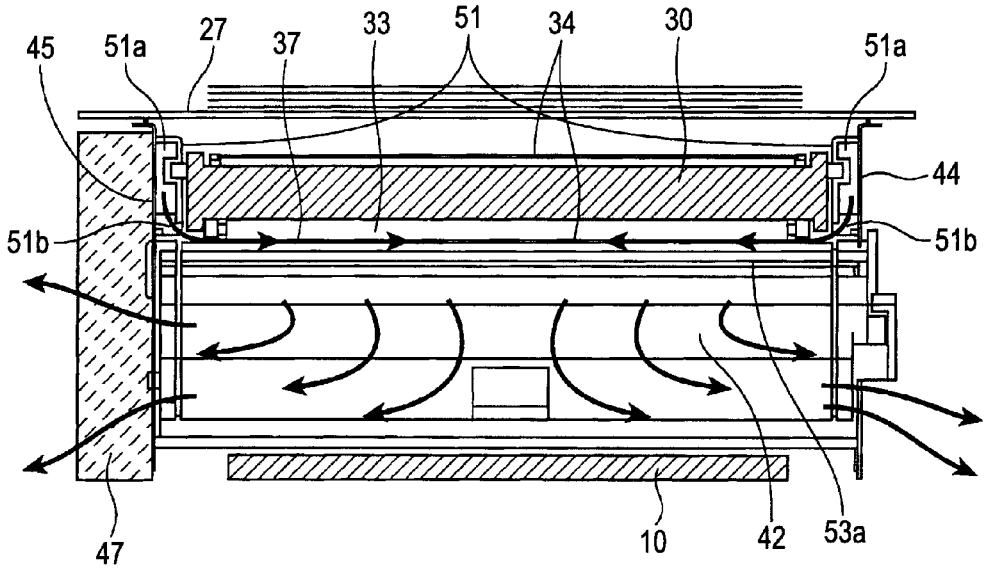
FIG. 5 is a schematic diagram of a cross section Y taken along a dashed line in FIG. 4.
Figure 6:
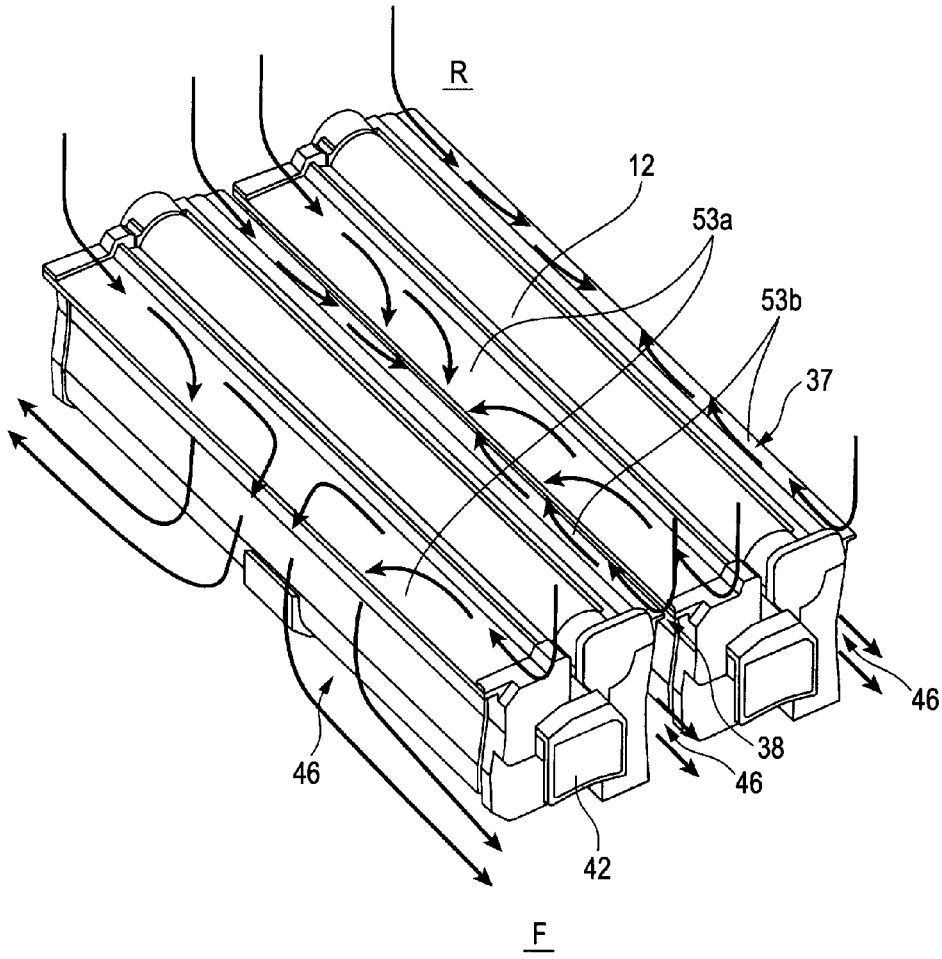
FIG. 6 is a diagram showing how cooling air flows around a process cartridge according to the second embodiment.
Figure 7:
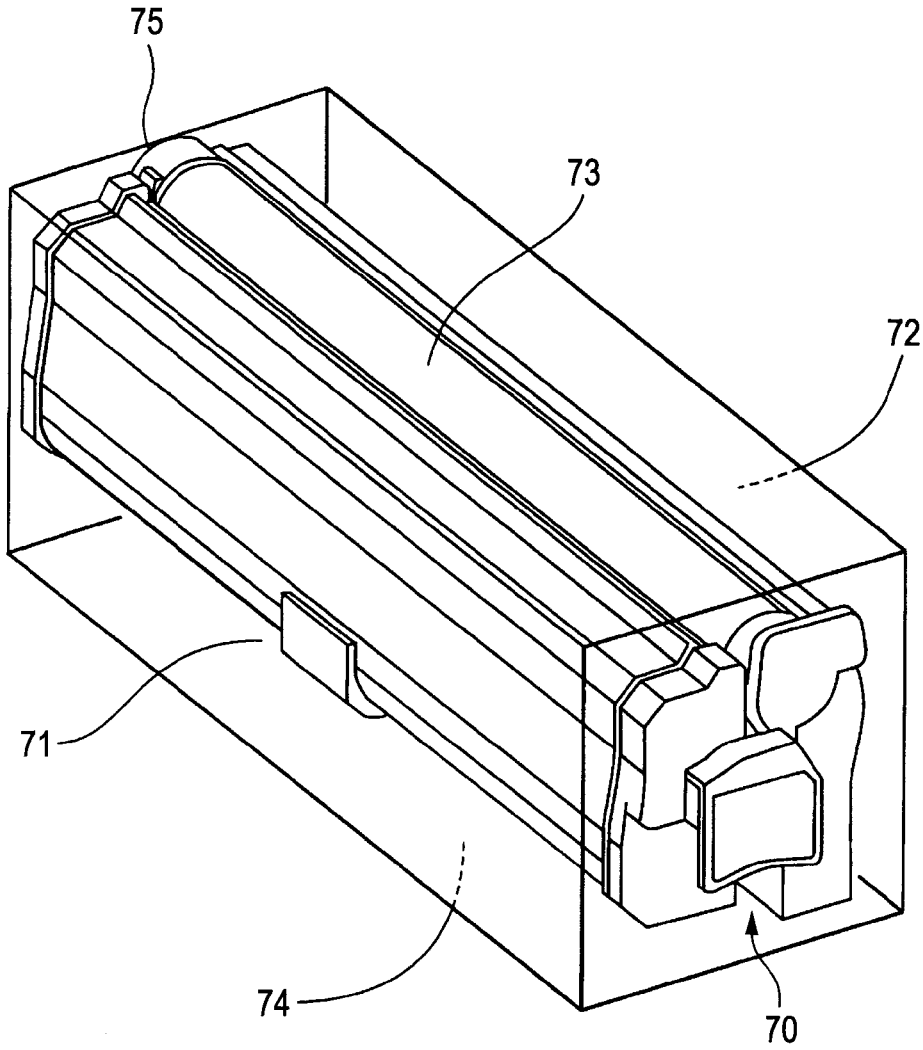
FIG. 7 is a diagram for illustrating spatial constraints around an imaging section according to a conventional technique.
Figure 8:
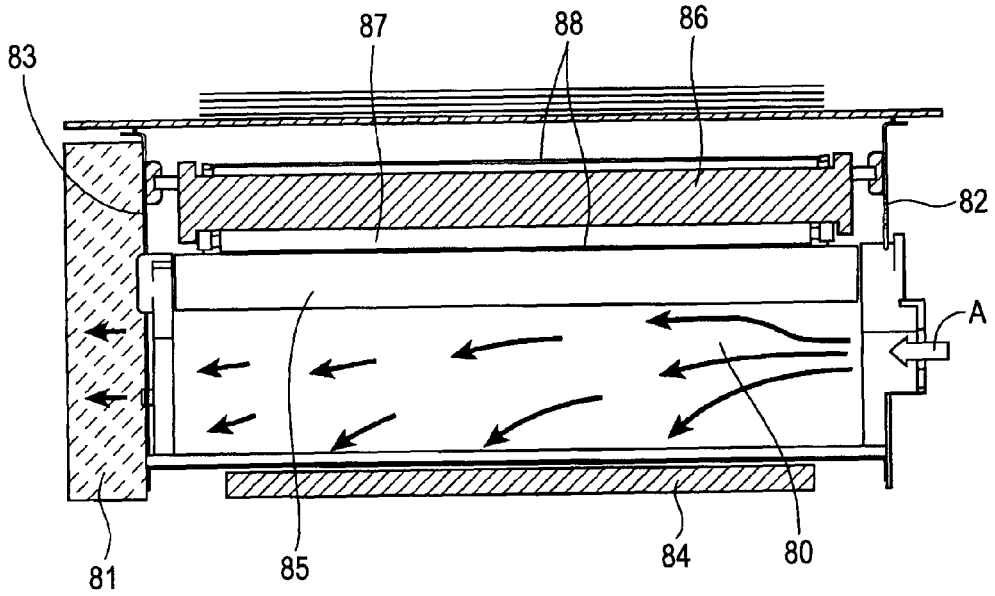
FIG. 8 is a diagram showing a cooling configuration around the imaging section according to the conventional technique.

A second embodiment of the present invention will be described below with reference to FIGS. 4 to 6. Except for cooling configuration for imaging sections, an image forming apparatus according to the present embodiment has a configuration similar to that of the first embodiment. Thus, the same elements as those in the first embodiment are denoted by the same reference numerals as the corresponding elements, and description thereof will be omitted.

Figure 4:
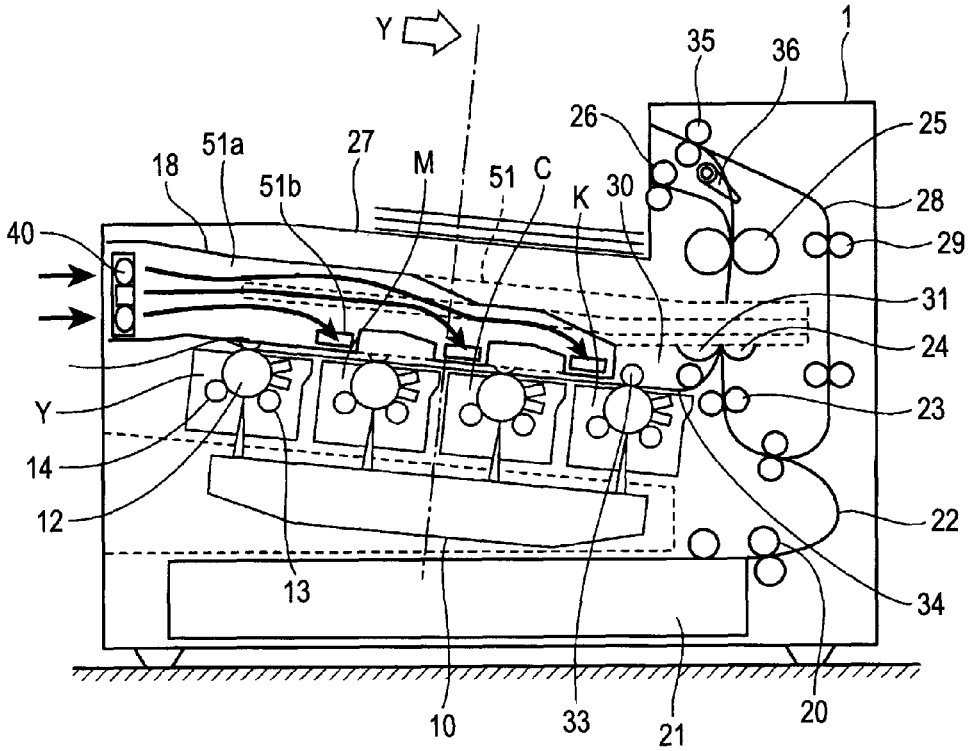
FIG. 4 is a sectional view showing a schematic configuration of an image forming apparatus according to a second embodiment.

FIG. 4 is a sectional view showing a schematic configuration of an image forming apparatus according to the present embodiment. FIG. 5 is a schematic diagram of a cross section Y taken along a dashed line in FIG. 4. FIG. 6 is a diagram showing how cooling air flows around a process cartridge 42 in the cooling configuration for the imaging section according to the present embodiment.

To attach and detach the intermediate transfer belt unit 30 (according to the present embodiment, a right-removable configuration shown in FIG. 4 is adopted), an ITB guide rail 51 is installed on each of the front side plate 44 and rear side plate 45 which make up the frame of the printer body 1.

A duct 51*a* is formed between the ITB guide rail 51 and front side plate 44 as well as between the ITB guide rail 51 and rear side plate 45. The ducts 51*a* are provided with a plurality of openings 51*b* leading to the spaces (gaps 37) between the intermediate transfer belt 34 and process cartridges 42. A single fan 40 is installed on the left flank of the printer body 1 to take fresh air into the apparatus. The air blown by the fan 40 is divided and sent to the ducts 51*a* in the respective ITB guide rails 51 of the front and rear side plates 44 and 45.

The cooling air is led to the plurality of openings 51*b* with its air flow volume being regulated, and is supplied from the plurality of openings 51*b* to the spaces between the intermediate transfer belt 34 and process cartridges 42. When passing through the ducts 51*a*, the cooling air cools the front side plate 44 and rear side plate 45 and thereby reduces the temperature difference between the front side plate 44 and rear side plate 45. This reduces color misregistration of color images caused by the difference in thermal expansion between the front and rear side plates 44 and 45.

The proportion and location of cooling air supply to each process cartridge 42 are optimized according to heat distribution characteristics in the printer body 1 and the like.

According to the present embodiment, regulating shapes (facing portions) 53*a* and 53*b* are provided on opposite sides of each process cartridge 42 at locations facing the intermediate transfer belt 34 to regulate the gap 38 between the adjacent process cartridges 42 to a predetermined size. The regulating shapes 53*a* and 53*b* face each other across the gap 38 in the space between the two process cartridges 42 located next to each other.

The gaps 38 regulated (formed) by the regulating shapes 53*a* and 53*b* of the process cartridges 42 located next to each other serve as air flow paths running from the side of the intermediate transfer belt 34 toward the exhaust spaces 46 and flow rates along the air flow paths are regulated. As in the case of the first embodiment, the gaps are shaped so as to equalize a temperature distribution in the elements of the process cartridges wherever possible in the longitudinal direction during image forming operation.

After flowing out to the exhaust spaces 46, the cooling air is discharged to outside the apparatus by passing through gaps among units and parts in the printer body 1 as in the case of the first embodiment.

In the cooling configuration for the imaging sections according to the present embodiment, the manner in which the cooling air flows around the process cartridge is basically the same as the first embodiment. Also, as in the case of the first embodiment, the shape of the process cartridges 42 may be designed such that the gaps 37 between the process cartridges 42 and intermediate transfer belt 34 will widen toward the longitudinal center from the longitudinal ends.

Also, the shape of the process cartridges 42 may be designed such that the gap 38 between each two process cartridges 42 located next to each other will widen toward the longitudinal center from both longitudinal ends.

In the first embodiment, the flow of air which envelops the entire process cartridges by moving from the side of the intermediate transfer belt 34 toward the exhaust spaces 46 is generated using the gaps defined by the stay members 43 and process cartridges 42. On the other hand, with the configuration according to the present embodiment, similar flow of air which envelops the entire process cartridges is generated using the gaps defined by the regulating shapes 53*a* and 53*b* provided on the process cartridges 42.

The present embodiment offers advantages similar to those described in the first embodiment.

[Other Embodiments]

The configuration to which the present invention is applicable is not limited to those of the two embodiments described above.

Although in the embodiments described above, the air blown by a single fan is divided and supplied to both longitudinal ends of the process cartridges 42, this is not restrictive, and air may be blown to the opposite ends by separate fans. Although in the first embodiment, the duct 41 for blowing air is installed in the space between the output tray 27 and intermediate transfer belt 34, the present invention is not limited to a configuration in which cooling air is blown to the intermediate transfer belt 34 in isolation. For example, a surface of the intermediate transfer belt 34 may double as a wall of an air flow path of the duct 41. Such a configuration will cause the surface of the intermediate transfer belt 34 to be exposed to cooling air, cooling the intermediate transfer belt 34 and thereby further reducing temperature increases of the process cartridges 42 indirectly during printing.

Also, although an intermediate-transfer image forming apparatus has been described in the above embodiments, this is not restrictive. That is, the present invention can be suitably applied to an image forming apparatus in which toner images formed on respective image bearing members are transferred onto a recording material carried and conveyed by a recording material conveyance belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-244312, filed Oct. 29, 2010, and No. 2011-224974, filed Oct. 12, 2011 which are hereby incorporated by reference herein in their entirety.

What is claimed is:

1. An image forming apparatus comprising:

a plurality of image forming units which are provided side by side at least in a horizontal direction, each of which includes a rotatable image bearing member and an image forming section adapted to form a toner image on the image bearing member;

an air blow device configured to generate an air flow to cool the plurality of image forming units;

a belt placed above the plurality of image forming units; and a changing member disposed in a space below the belt and between two image forming units located next to each other among the plurality of image forming units and configured to change flowing direction of the air flow generated by the air blow device, wherein the changing member directs the air flow to flow along a rotation axis direction of the image bearing member from both ends of an upper area of the space toward a center of the upper area of the space, and then flow from the center of the upper area of the space to below the space.

2. An image forming apparatus according to claim 1, wherein the changing member comprises an image forming unit facing portion which faces at least one of the two image forming units, wherein a gap is formed between the image forming unit facing portion and the image forming units, and a width of the gap becomes wider from both ends of the gap toward a center of the gap in the rotation axis direction.

3. An image forming apparatus according to claim 1, wherein the changing member comprises a belt facing portion which faces the belt; and wherein a gap is formed between the belt facing portion and the image forming units, and a width of the gap becomes wider from both ends of the gap toward a center of the gap in the rotation axis direction.

4. An image forming apparatus according to claim 1, further comprising two side plates provided at both ends of the plurality of image forming units in the rotation axis direction, wherein the changing member includes a stay member configured to couple the two side plates to each other in the rotation axis direction.

5. An image forming apparatus according to claim 4, wherein the two side plates are each provided with a positioning portion configured to position the image forming units; and the air flow generated by the air blow device is supplied to the positioning portions.

6. An image forming apparatus according to claim 1, wherein the air flow generated by the air blow device reaches both ends of the upper area of the space by passing outside both ends of the belt.

7. An image forming apparatus according to claim 6, further comprising a duct for the air flow generated by the air blow device to pass through, wherein openings are formed in the duct, the openings facing both ends of the respective spaces in the rotation axis direction; and wherein the duct divides the air flow generated above the belt by the air blow device into directions toward both sides of the belt in the rotation axis direction and supplies the air flow to both ends of the upper area of the spaces in the rotation axis direction through the openings.

8. An image forming apparatus according to claim 6, further comprising an exposure device placed below the image forming units and configured to expose the image bearing member.

9. An image forming apparatus comprising:

a plurality of image forming units which are provided side by side, each of which includes a rotatable image bearing member and an image forming section adapted to form a toner image on the image bearing member;

an air blow device configured to generate an air flow to cool the plurality of image forming units; and a changing member installed in a space between two image forming units located next to each other among the plurality of image forming units and configured to change direction of the air flow generated by the air blow device, wherein the air flow generated by the air blow device flows toward a center of the space from both ends of the space in a rotation axis direction of the image bearing member by the changing member, wherein the changing member comprises an image forming unit facing portion which faces at least one of the two image forming units, and wherein a gap is formed between the image forming unit facing portion and the image forming units, and a width of the gap becomes wider from both ends of the gap toward a center of the gap in the rotation axis direction.

10. An image forming apparatus according to claim 9, further comprising two side plates provided at both ends of the plurality of image forming units in the rotation axis direction, wherein the changing member includes a stay member configured to couple the two side plates to each other in the rotation axis direction.

11. An image forming apparatus according to claim 10, wherein the two side plates are each provided with a positioning portion configured to position the image forming units; and the air flow generated by the air blow device is supplied to the positioning portions.

12. An image forming apparatus according to claim 9, further comprising a belt placed above the image forming units and configured to move in order to transfer a toner image formed on the image bearing member onto a recording material, wherein the air flow generated by the air blow device moves to both ends of the space in the rotation axis direction by passing outside both ends of the belt.

13. An image forming apparatus comprising:

a plurality of image forming units which are provided side by side, each of which includes a rotatable image bearing member and an image forming section adapted to form a toner image on the image bearing member;

an air blow device configured to generate an air flow to cool the plurality of image forming units:

a changing member installed in a space between two image forming units located next to each other among the plurality of image forming units and configured to change direction of the air flow generated by the air blow device; and a belt configured to move in order to transfer a toner image formed on the image bearing member onto a recording material, wherein the changing member comprises a belt facing portion which faces the belt, wherein the air flow generated by the air blow device flows toward a center of the space from both ends of the space in a rotation axis direction of the image bearing member by the changing member, and wherein a gap is formed between the belt facing portion and the image forming units, and a width of the gap becomes wider from both ends of the gap toward a center of the gap in the rotation axis direction.

14. An image forming apparatus according to claim 13, further comprising two side plates provided at both ends of the plurality of image forming units in the rotation axis direction, wherein the changing member includes a stay member configured to couple the two side plates to each other in the rotation axis direction.

15. An image forming apparatus according to claim 14, wherein the two side plates are each provided with a positioning portion configured to position the image forming units; and the air flow generated by the air blow device is supplied to the positioning portions.

16. An image forming apparatus according to claim 13, further comprising a belt placed above the image forming units and configured to move in order to transfer a toner image formed on the image bearing member onto a recording material, wherein the air flow generated by the air blow device moves to both ends of the space in the rotation axis direction by passing outside both ends of the belt.

17. An image forming apparatus comprising:

a plurality of image forming units which are provided side by side at least in a horizontal direction, each of which includes a rotatable image bearing member and an image forming section adapted to form a toner image on the image bearing member;

an air blow device configured to generate an air flow to cool the plurality of image forming units;

a belt placed above the plurality of image forming units; and a stay member disposed in a space below the belt and between two image forming units located next to each other among the plurality of image forming units, wherein the air flow generated by the air blow device is directed along a rotation axis direction of the image bearing member from both ends of an upper area of the space toward a center of the upper area of the space, and then is directed from the center of the upper area of the space to below the space.

18. An image forming apparatus according to claim 17, wherein the stay member comprises an image forming unit facing portion which faces at least one of the two image forming units.

19. An image forming apparatus according to claim 18, wherein a gap is formed between the image forming unit facing portion and the image forming units, and a width of the gap becomes wider from both ends of the gap toward a center of the gap in the rotation axis direction.

20. An image forming apparatus according to claim 17, wherein the stay member comprises a belt facing portion which faces the belt.

21. An image forming apparatus according to claim 20, wherein a gap is formed between the belt facing portion and the image forming units, and a width of the gap becomes wider from both ends of the gap toward a center of the gap in the rotation axis direction.

22. An image forming apparatus according to claim 17, wherein the stay member comprises an image forming unit facing a portion which faces at least one of the two image forming units and a belt facing portion which faces the belt.

23. An image forming apparatus according to claim 17, further comprising two side plates provided at both ends of the plurality of image forming units in the rotation axis direction, wherein the stay member configured to couple the two side plates to each other in the rotation axis direction.

24. An image forming apparatus according to claim 23, wherein the two side plates are each provided with a positioning portion configured to position the image forming units; and the air flow generated by the air blow device is supplied to the positioning portions.

25. An image forming apparatus according to claim 17, wherein the air flow generated by the air blow device reaches both ends of the upper area of the space by passing outside both ends of the belt.

* * * * *